US010598368B2

(12) United States Patent
Joye

(10) Patent No.: US 10,598,368 B2
(45) Date of Patent: Mar. 24, 2020

(54) PATHLIGHT

(71) Applicant: AURORALIGHT, INC., Carlsbad, CA (US)

(72) Inventor: Michael Joye, Carlsbad, CA (US)

(73) Assignee: AURORALIGHT, INC., Carlsbad, CA (US)

( * ) Notice: Subject to any disclaimer, the term of this patent is extended or adjusted under 35 U.S.C. 154(b) by 120 days.

(21) Appl. No.: 15/886,682

(22) Filed: Feb. 1, 2018

(65) Prior Publication Data

US 2018/0216812 A1 Aug. 2, 2018

Related U.S. Application Data

(60) Provisional application No. 62/453,037, filed on Feb. 1, 2017.

(51) Int. Cl.

| | |
|---|---|
| ***F21V 21/00*** | (2006.01) |
| ***F21V 29/70*** | (2015.01) |
| ***F21V 11/00*** | (2015.01) |
| ***F21V 14/02*** | (2006.01) |
| ***F21V 7/24*** | (2018.01) |
| ***F21S 8/08*** | (2006.01) |
| ***F21V 21/116*** | (2006.01) |
| *F21W 131/10* | (2006.01) |
| *F21V 29/89* | (2015.01) |
| *F21V 23/06* | (2006.01) |
| *F21Y 115/10* | (2016.01) |
| *F21W 131/109* | (2006.01) |

(52) U.S. Cl.

CPC ..... *F21V 29/70* (2015.01); *F21S 8/086* (2013.01); *F21V 7/24* (2018.02); *F21V 11/00* (2013.01); *F21V 14/02* (2013.01); *F21V 21/116* (2013.01); *F21V 23/06* (2013.01); *F21V 29/89* (2015.01); *F21W 2131/10* (2013.01); *F21W 2131/109* (2013.01); *F21Y 2115/10* (2016.08)

(58) Field of Classification Search

CPC ..... F21V 29/70; F21V 21/116; F21V 11/00; F21V 2115/10; F21V 23/06; F21S 8/086; F21W 2131/109; F21W 2131/10

USPC ..... 362/249.03

See application file for complete search history.

(56) References Cited

U.S. PATENT DOCUMENTS

| | | | | |
|---|---|---|---|---|
| 6,422,717 | B1 * | 7/2002 | Beadle | F21S 8/08 362/187 |
| 8,534,867 | B1 * | 9/2013 | Beadle | F21V 17/002 362/153.1 |
| 8,939,600 | B1 * | 1/2015 | Beadle | F21V 31/04 362/158 |
| 9,488,326 | B2 * | 11/2016 | Allen | F21S 6/005 |
| 2010/0265716 | A1 * | 10/2010 | Hood | F21S 6/003 362/282 |
| 2013/0188353 | A1 * | 7/2013 | Nankil | F21V 21/14 362/235 |

* cited by examiner

*Primary Examiner* — Ali Alavi

(74) *Attorney, Agent, or Firm* — Cermak Nakajima & McGowan LLP; Malcolm K. McGowan

(57) ABSTRACT

Pathlights for illuminating paths, walkways, and other landscape and architectural features advantageously incorporate light emitting diodes ("LEDs") as an illumination source, and a visor which both directs the light and dissipates heat generated by the LEDs.

14 Claims, 4 Drawing Sheets

PATHLIGHT

FIELD OF ENDEAVOR

The present invention relates to devices, systems, and processes useful in the construction of optical lighting devices.

BRIEF DESCRIPTION OF THE RELATED ART

Prior pathlights have been available in many different configurations. Heat from the light sources, e.g., bulbs, often is difficult to dissipate while still providing a pathlight that can be oriented in different directions.

SUMMARY

Described herein are pathlights for illuminating paths, walkways, and other landscape and architectural features. The pathlight described advantageously incorporates light emitting diodes ("LEDs") as an illumination source, and a visor which both directs the light and dissipates heat generated by the LEDs.

DETAILED DESCRIPTION

Figure 1C:
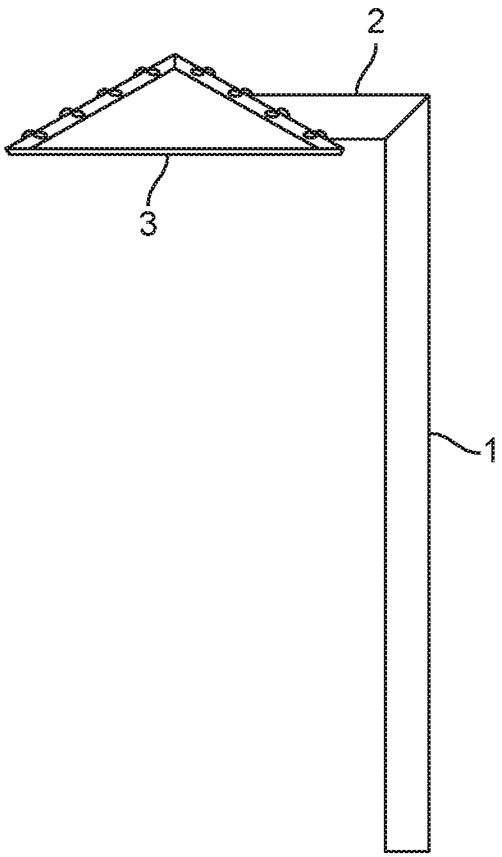
FIGS. 1B and 1C show examples of a pathlight as described herein in elevational views.

Provided herein is a pathlight having a vertical support member 1; a horizontal support member 2 attached to the vertical support member 1; an LED module 4 having at least one light emitting diode; means 5 for rotatably attaching the LED module 4 to the horizontal support member 2; and a top or visor 3 removably attached to the means 5 for rotatably attaching, wherein the visor 3 is configured to dissipate heat generated by the LED module.

Figure 2B:
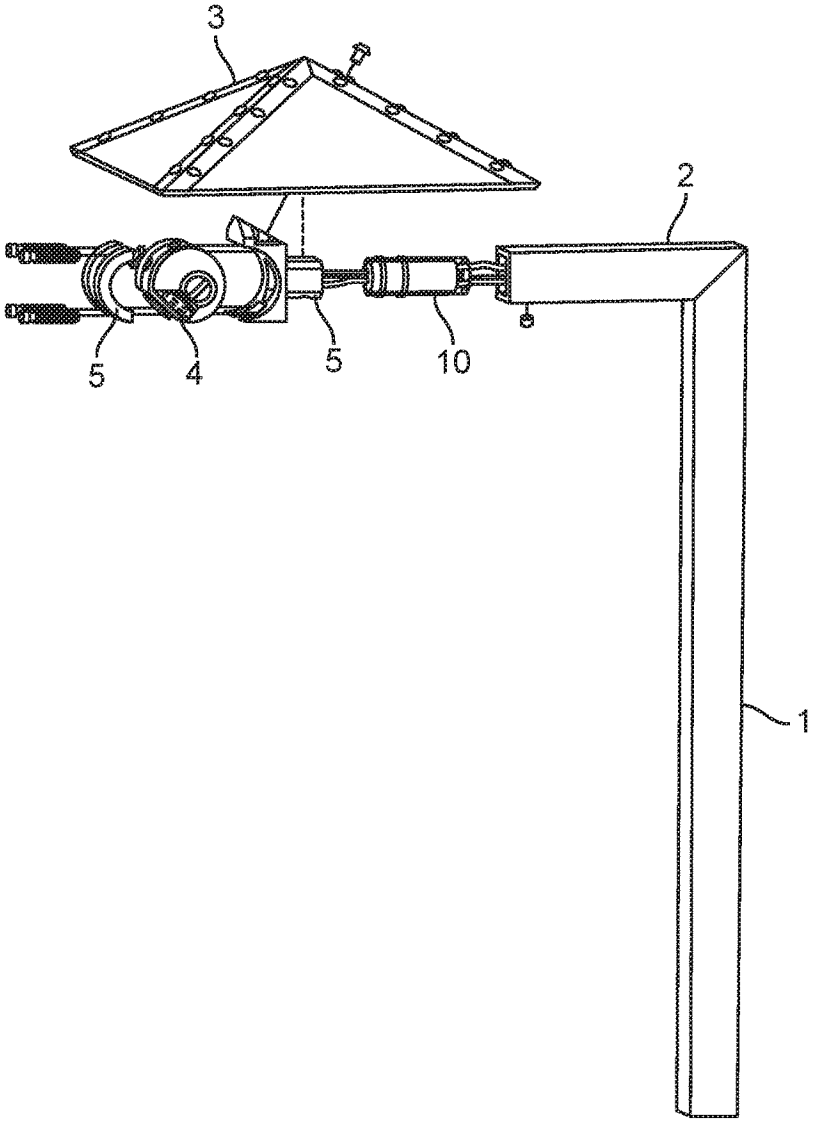
FIG. 2B shows an exploded, perspective view of a pathlight as described herein.
Figure 2A:
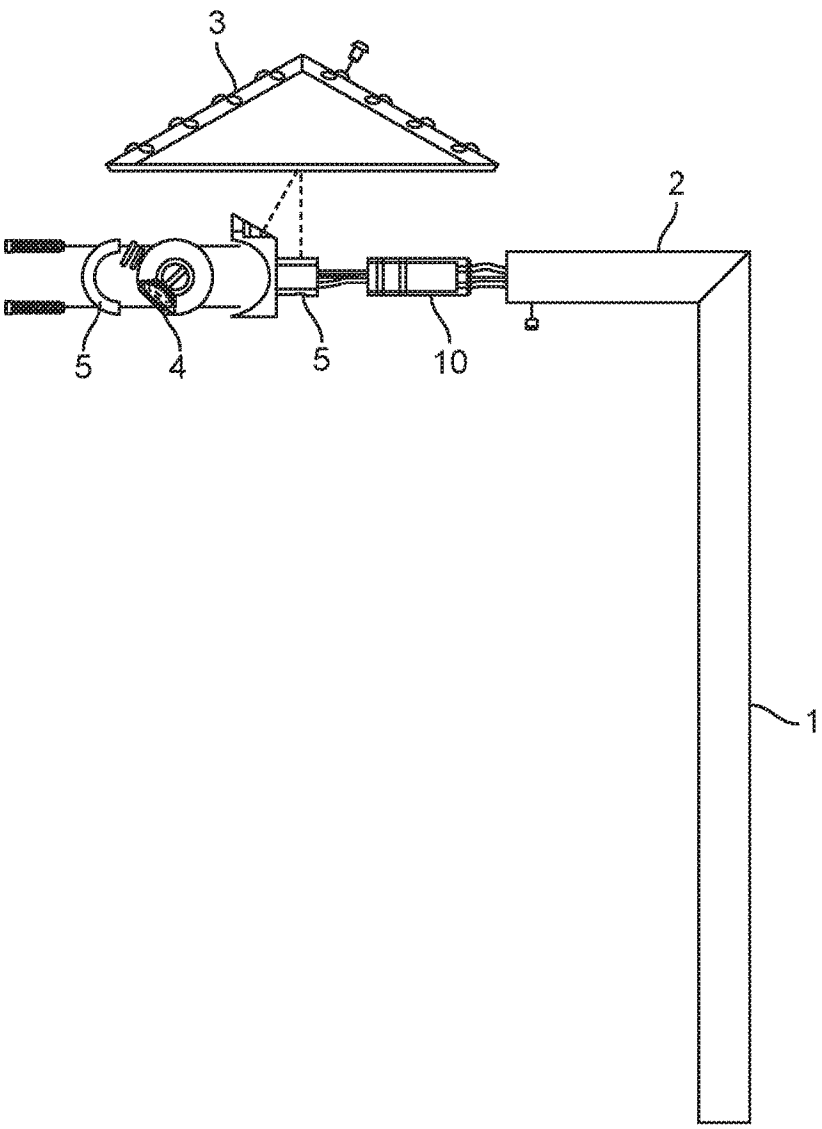
FIG. 2A shows an exploded view of a pathlight as described herein, in isometric view.

The support members may be solid, or hollow. As shown in FIGS. 2A and 2B, when the support members 1, 2 are hollow, a connector 10 electrically connects the LED module 4 to a power source may be disposed within the lumen of the hollow support members 1, 2. The support members 1, 2 may be of any suitable shape in cross-section. In the embodiment shown in FIGS. 2A and 2B, the support members 1, 2, are square in cross-section.

Figure 1B:
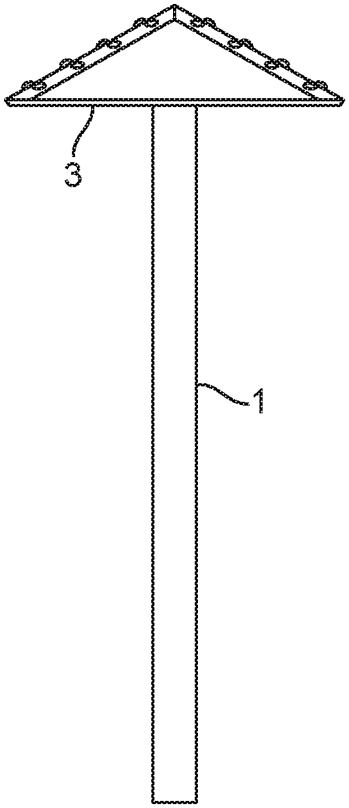
Figure 1A:
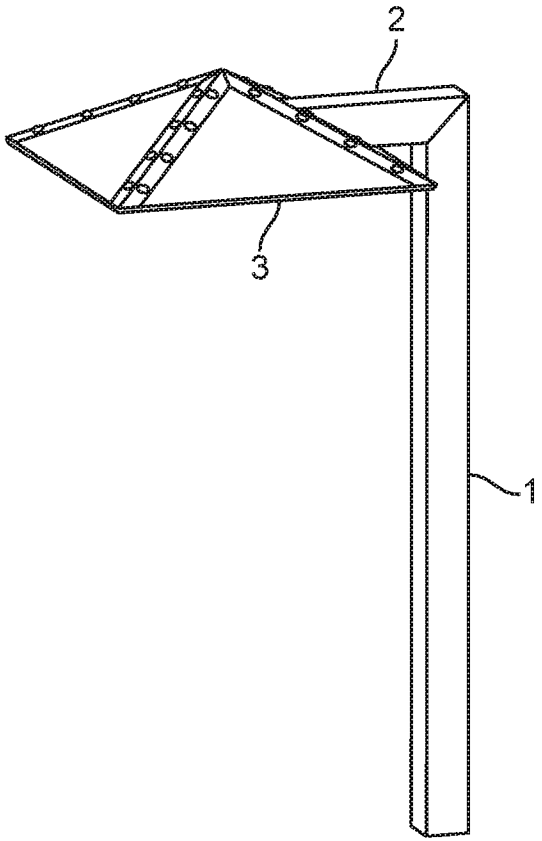
FIG. 1A shows one example of a pathlight as described herein, in isometric view.

The visor 3 may be of any desired shape, provided that the shape does not interfere with the ability of the visor to dissipate heat generated by the LED module. In the embodiment shown in FIGS. 1A-1C, the visor 3 is pyramidal in shape. The visor 3 may be transparent, translucent, or opaque. The side of the visor 3 adjacent to the LED module 4 may be covered with a reflective material. The visor 3 may be advantageously constructed of a metal which combines heat dissipation properties and corrosion resistance, such as copper or brass.

Figure 3:
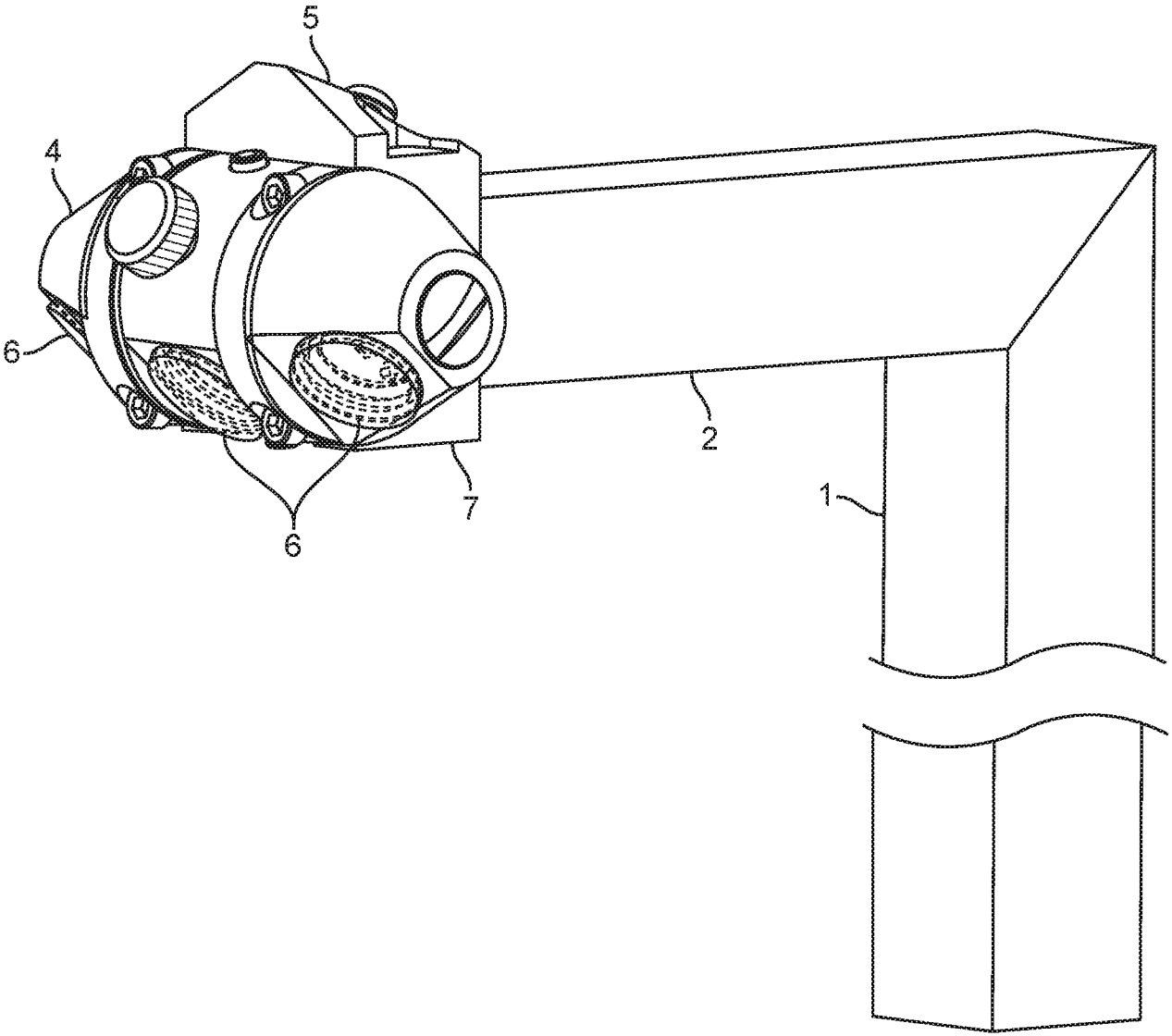
FIG. 3 shows an expanded view of a pathlight as described herein, with the visor removed to show the attachment of the LED module to the horizontal member.

The LED module is mounted to the horizontal member by a bracket 7, as shown in FIG. 3, or other means that permit it to rotate in the plane formed by the vertical and horizontal support members. In the embodiment shown in FIG. 3, the LED module 4 can rotate through 60° in the plane formed by the vertical 1 and horizontal 2 support members.

The LED module 4 will contain one or more light emitting diodes; in the embodiment shown in FIG. 3, the LED module 4 includes three light emitting diodes 6.

Figure 4B:
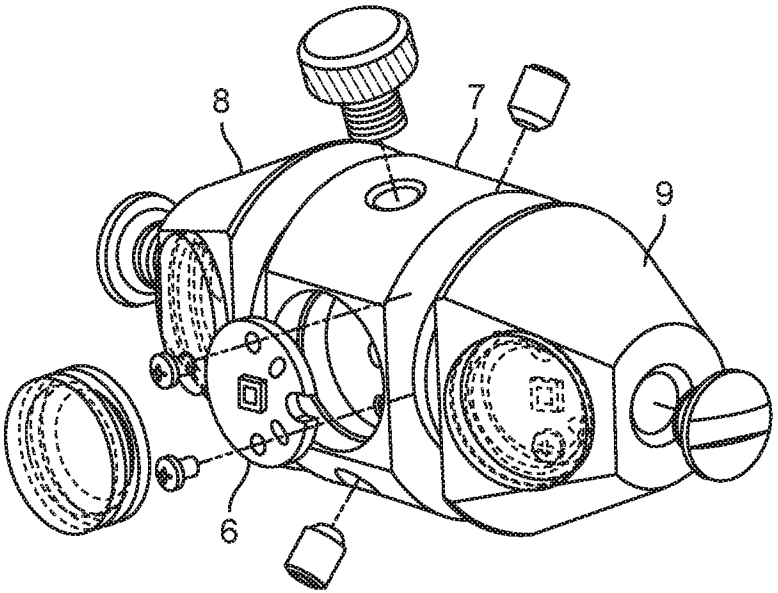
FIG. 4A shows an isometric view and FIG. 4B shows an exploded view of an LED module as described herein.
Figure 4A:
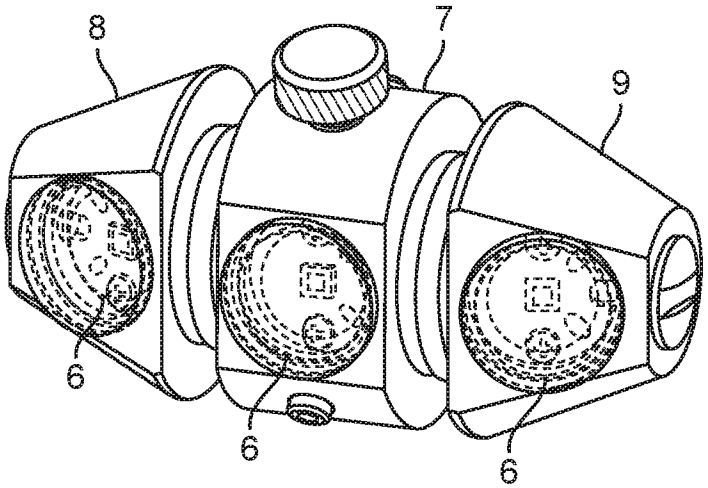

The LED module 4 may be of any suitable shape that permits rotation. For example, the LED module may be substantially cylindrical. In the embodiment shown in FIGS. 4A and 4B, the LED module 4 has a central cylindrical section 7, and first 8 and second 9 frustoconical sections disposed at opposite ends of the cylindrical section 7. In the embodiment shown in FIGS. 4A and 4B, one light emitting diode is mounted in each of the cylindrical section 7 and the first 8 and second 9 frustoconical sections. Optionally, the frustoconical sections are rotatably attached to the cylindrical section.

The preceding is merely a detailed description of various embodiments of this invention and that numerous changes to the disclosed embodiments can be made in accordance with the disclosure herein without departing from the spirit or scope of the invention. Rather, the scope of the invention is to be determined only by the appended claims and their equivalents.

What is claimed is:

1. A pathlight comprising:

a vertical support member;

a horizontal support member attached to the vertical support member;

an LED module comprising a plurality of light emitting diodes;

a visor;

means for rotatably attaching the LED module to the horizontal support member or visor;

wherein the visor is removably attached to the means for rotatably attaching; and wherein heat from the rotatable LED module can be dissipated through the visor, through the horizontal support member, or through both.

2. The pathlight of claim 1, wherein the vertical and horizontal support members are hollow.

3. The pathlight of claim 2, further comprising means for electrically connecting the LED module to a power source, wherein the means for connecting is disposed within the lumen of the hollow support members.

4. The pathlight of claim 1, wherein the visor is pyramidal in shape.

5. The pathlight of claim 1, wherein the visor is opaque.

6. The pathlight of claim 5, wherein at least one surface of the visor is covered with a reflective material.

7. The pathlight of claim 5, wherein the visor comprises copper or brass.

8. The pathlight of claim 1, wherein the vertical support member is square in cross-section.

9. The pathlight of claim 1, wherein the horizontal support member is square in cross-section.

10. The pathlight of claim 1, wherein the LED module is configured to rotate through 60° in a plane formed by the vertical and horizontal support members.

11. The pathlight of claim 1, wherein the LED module comprises three light emitting diodes.

12. The pathlight of claim 1, wherein the LED module comprises a central cylindrical section, and first and second frustoconical sections disposed at opposite ends of the cylindrical section.

13. The pathlight of claim 12, wherein at least one light emitting diode is mounted in each of the cylindrical section and the first and second frustoconical sections.

14. The pathlight of claim 12, wherein the frustoconical sections are rotatably attached to the cylindrical section.

* * * * *